US011753283B2

(12) United States Patent
Paoletti

(10) Patent No.: US 11,753,283 B2
(45) Date of Patent: Sep. 12, 2023

(54) WINCH ASSEMBLY FOR ASSISTING THE MOVEMENT OF A TRACKED VEHICLE AND CONTROL METHOD THEREOF

(71) Applicant: PRINOTH S.P.A., Vipiteno (IT)

(72) Inventor: Alberto Paoletti, Vipiteno (IT)

(73) Assignee: PRINOTH S.P.A., Vipiteno (IT)

( * ) Notice: Subject to any disclaimer, the term of this patent is extended or adjusted under 35 U.S.C. 154(b) by 562 days.

(21) Appl. No.: 16/619,350

(22) PCT Filed: Jun. 8, 2018

(86) PCT No.: PCT/IB2018/054163

§ 371 (c)(1),
(2) Date: Dec. 4, 2019

(87) PCT Pub. No.: WO2018/225031

PCT Pub. Date: Dec. 13, 2018

(65) Prior Publication Data

US 2020/0115202 A1 Apr. 16, 2020

(30) Foreign Application Priority Data

Jun. 9, 2017 (IT) ..... 102017000064293

(51) Int. Cl.
*B66D 1/48* (2006.01)
*B66D 1/08* (2006.01)
*E01H 4/02* (2006.01)

(52) U.S. Cl.
CPC ..... *B66D 1/485* (2013.01); *B66D 1/08* (2013.01); *B66D 2700/0133* (2013.01); *E01H 4/02* (2013.01)

(58) Field of Classification Search
CPC .. B66D 1/485; B66D 1/08; B66D 2700/0133; B66D 1/48; E01H 4/02
See application file for complete search history.

(56) References Cited

U.S. PATENT DOCUMENTS 3,762,777 A 10/1973 Jacob
5,984,277 A 11/1999 Kanzler et al.
(Continued)

FOREIGN PATENT DOCUMENTS

CN 2767413 Y 3/2006
CN 101011980 A 8/2007
(Continued)

OTHER PUBLICATIONS

Chinese Office Action for Application No. 201810592392.3 dated Sep. 10, 2020 (18 pages).
(Continued)

*Primary Examiner* — Sang K Kim
*Assistant Examiner* — Nathaniel L Adams
(74) *Attorney, Agent, or Firm* — Neal, Gerber & Eisenberg LLP

(57) ABSTRACT

A winch assembly comprising a support structure, a drum revolving about an axis; a cable wound around the drum; an actuator assembly coupled to the drum to wind or unwind the cable and configured to receive a first control signal, indicative of a desired pressure of a pump of the actuator assembly, and/or a second control signal, indicative of a desired displacement of the pump; and a winch control device coupled to the actuator assembly to control the winding and unwinding of the cable and configured to determine the first control signal and/or the second control signal according to a measured speed of travel signal indicating the measured speed of travel of the tracked vehicle, a measured pulling force signal indicating the pulling force measured on the winch assembly, and one or more signals selected from the following group of signals: cable speed signal, wound cable length signal, desired pulling force signal set manually by an operator, signal from the measured angle of the arm of the winch assembly with respect to a
(Continued)

direction of travel, and measured pressure signal indicative of a pressure measured in a high pressure branch of the hydraulic circuit of the actuator assembly.

17 Claims, 3 Drawing Sheets

(56) References Cited

U.S. PATENT DOCUMENTS

| | | | | |
|---|---|---|---|---|
| 7,165,758 | B2 * | 1/2007 | Kanzler | B66D 1/505 180/7.5 |
| 2008/0164365 | A1 * | 7/2008 | Ueki | B66D 1/50 242/410 |
| 2016/0060082 | A1 * | 3/2016 | Huang | B66D 1/08 254/342 |

FOREIGN PATENT DOCUMENTS

| | | | | |
|---|---|---|---|---|
| CN | 101081528 | A | 12/2007 | |
| CN | 104379433 | A | 2/2015 | |
| DE | 10322377 | A1 * | 12/2004 | B60K 17/10 |
| EP | 1 118 580 | A1 | 7/2001 | |
| EP | 2554750 | A2 * | 2/2013 | E01H 4/02 |
| EP | 2444355 | B1 * | 9/2015 | E01H 4/02 |
| RU | 2525259 | | 8/2014 | |
| SU | 519388 | | 6/1976 | |
| SU | 1293098 | | 2/1987 | |
| WO | WO 2010/103117 | | 9/2010 | |

OTHER PUBLICATIONS

Notification Concerning Submission, Obtention or Transmittal of Priority Document for International Application No. PCT/IB2018/054163 dated Oct. 3, 2018.

International Search Report and Written Opinion for International Application No. PCT/IB2018/054163 dated Sep. 27, 2018.

Russian Office Action for Application No. 2019140858/11 dated Oct. 20, 2021 (6 pages).

* cited by examiner

WINCH ASSEMBLY FOR ASSISTING THE MOVEMENT OF A TRACKED VEHICLE AND CONTROL METHOD THEREOF

PRIORITY CLAIM

This application is a national stage application of PCT/IB2018/054163, filed on Jun. 8, 2018, which claims the benefit of and priority to Italian Patent Application No. 102017000064293, filed on Jun. 9, 2017, the entire contents of which are each incorporated by reference herein.

TECHNICAL FIELD

The present disclosure relates to a winch assembly for assisting the movement of a tracked vehicle, in particular a snow groomer, along relatively steep slopes and the control method thereof.

In particular, a tracked vehicle comprises a chassis; a vehicle control unit; and the winch assembly, which in turn comprises a support structure; a drum rotatable with respect to the support structure; a cable which can be wound and unwound around the drum; an actuator assembly coupled to the drum to rotate the drum about the axis; and a winch control device coupled to the actuator assembly for controlling the actuator assembly so as to adjust the winding and unwinding of the cable.

BACKGROUND

Generally, a tracked snow grooming vehicle includes a tiller for processing the snow of the ski slopes and a shovel for moving snow masses along the ski slopes.

When the tracked vehicle is used on a piste characterised by particularly relative steep slopes the free end of the cable of the winch assembly is fixed to an upstream anchor so as to maneuver the tracked vehicle with the aid of the winch assembly, ensure relatively greater safety and prevent slipping of the tracked vehicle if the tracked vehicle loses adherence to the snow.

European Patent No. EP 1 118 580 discloses a method for controlling the winch assembly so that the pulling force of the cable changes according to the difference in the pressure values between the two pumps which supply the tracks of the snow grooming vehicle and the angle of the winch arm with respect to the direction of travel.

The control method works relatively well within certain limits but is not very suitable when relatively very short reaction times and relatively strong robustness with respect to internal and external troubles are required.

SUMMARY

One object of the present disclosure is to provide a winch assembly which overcomes at least one of the drawbacks of certain of the prior art.

According to the present disclosure, there is provided a winch assembly comprising a support structure, a drum rotatable with respect to the support structure about an axis; a cable which can be wound and unwound around the drum; an actuator assembly coupled to the drum to define a pulling force of the cable and configured to receive a first control signal, indicative of a desired pressure of a pump of the actuator assembly, and/or a second control signal, indicative of a desired displacement of the pump of the actuator assembly; and a winch control device coupled to the actuator assembly to control the pulling force of the cable and configured to provide the first control signal and/or the second control signal; the winch control device being configured to determine the first control signal and/or the second control signal according to a measured speed of travel signal indicating the measured speed of travel of the tracked vehicle, a measured pulling force signal indicating the pulling force measured on the winch assembly, and one or more signals selected from the following group of signals: cable speed signal, wound cable length signal, desired pulling force signal set manually by an operator, arm angle signal indicative of the angle of the winch arm with respect to a direction of travel, and measured pressure signal indicative of the pressure measured in a high pressure branch of a hydraulic circuit of the actuator assembly.

It should be appreciated that in accordance with the present disclosure, the winch assembly provides relative precision in the control of the pulling force even for relatively high pulling force values and relatively very short reaction times in order to counter sudden changes in external load due to sudden ground changes or sudden changes in load of the tracked vehicle.

According to certain embodiments, the winch control device determines the first control signal and/or the second control signal according to the pressure associated with at least one of the pumps of at least one of the tracks or the difference in the associated pressures between two pumps of two tracks.

According to certain embodiments, the winch control device comprises a first frequency-adjustable active filter and an oscillation detector configured to receive, as input, the measured force signal and provide, as output, one or more frequency values if an oscillation in the measured force signal is detected; the first active filter being frequency-adjusted according to the frequency or frequencies detected by the oscillation detector so as to damp or eliminate the oscillations in the pulling force; the winch control device being configured to define the first control signal by the first active filter. In certain such embodiments, the oscillation detector is configured to detect the oscillations by detecting the frequencies related to the harmonics having amplitude values greater than a given value and within a first range of detection frequencies.

It should be appreciated that in accordance with the present disclosure, the winch assembly is insensitive to internal or external troubles in the control of the pulling force of the winch and provides a system of control of the pulling force having relatively fast and stable dynamics. In greater detail, in accordance with the present disclosure, the control of the pulling force is capable of reacting relatively quickly to the operator's commands and/or to load changes due to external causes.

According to certain embodiments, the winch control device defines the first control signal according to the measured pulling force signal indicating the pulling force measured on the winch assembly.

It should be appreciated that in accordance with the present disclosure, the first control signal involved in adjusting the pulling force of the winch assembly is a feedback-controlled signal so that the desired force value is equal to that of the current winch force.

According to certain embodiments, the winch control device defines the first control signal according to the measured angle signal indicating the measured angle of the winch arm with respect to the direction of travel.

It should be appreciated that in accordance with the present disclosure, the pulling force is adjusted according to the pulling direction and the direction of travel, in particular, the pulling force is limited in some circumstances.

According to certain embodiments, the winch control device defines the first control signal according to the cable speed signal.

According to certain embodiments, the winch control device defines the first control signal according to the wound cable length signal.

It should be appreciated that in accordance with the present disclosure, the control device ensures a relatively more precise, faster and more stable adjustment of the pulling force. That is, the value of the wound cable length allows a relatively better adjustment of the torque to be applied to the drum so as to obtain a given or designated pulling force.

According to certain embodiments, the winch control device defines the first control signal according to the signal from the measured speed of travel of the tracked vehicle indicating the measured speed of travel of the tracked vehicle.

According to certain embodiments, the winch control device defines the first control signal according to the desired pulling force signal defined through an external manual command given by an operator.

According to certain embodiments, the winch control device defines the first control signal according to the track pressure signal indicative of the measured pressure of at least one pump which supplies a respective track. In certain such embodiments, the track pressure signal is indicative of the difference in the measured pressures between the hydraulic circuits supplying the first and the second track, respectively, of the tracked vehicle.

According to certain embodiments, the winch control device defines the second control signal according to the measured angle signal.

According to certain embodiments, the winch control device defines the second control signal according to the cable speed signal.

According to certain embodiments, the winch control device defines the second control signal according to the wound cable length signal.

According to certain embodiments, the winch control device defines the second control signal according to the desired pulling force signal.

According to certain embodiments, the winch control device defines the second control signal according to the measured pulling force signal.

According to certain embodiments, the winch control device defines the second control signal according to the measured speed of travel signal.

According to certain embodiments, the winch control device defines the second control signal according to the measured pressure signal indicating the pressure measured in the high pressure branch of the hydraulic circuit of the actuator assembly.

According to certain embodiments, the winch control device defines the second control signal according to the signal from the engine revolutions of the tracked vehicle.

According to certain embodiments, the winch control device defines the second control signal according to the measured pressure of at least one of the pumps of at least one of the tracks and/or the difference in the measured pressures between two pumps of two tracks.

According to certain embodiments, the winch control device defines the second control signal according to a desired theoretical force value.

According to certain embodiments, the winch control device comprises a second frequency-adjustable active filter and an oscillation detector configured to receive, as input, the measured force signal and provide, as output, one or more frequency values if an oscillation in the measured force signal is detected; the second active filter being frequency-adjusted according to the frequency or frequencies detected by the oscillation detector so as to dampen or eliminate the oscillations in the pulling force; the winch control device being configured to define the second control signal by the second active filter. In certain such embodiments, the oscillation detector is configured to detect the oscillations by detecting the frequencies related to the harmonics having amplitude values greater than a given value.

According to certain embodiments, the actuator assembly comprises a hydraulic circuit and a variable displacement pump which supplies the hydraulic circuit and is configured to vary its displacement according to: the pressure measured in the high pressure branch of the hydraulic circuit, the pressure indicated by the first control signal, and, in certain embodiments, according to the second control signal.

It should be appreciated that in accordance with the present disclosure, the variable displacement pump is controlled through the first signal which is a signal obtained by a feedback control on the pulling force of the winch assembly and a feedback on the hydraulic pressure of the hydraulic circuit. In other words, the pump is controlled through two feedbacks: an electronic feedback via electronic devices on the measured pulling force and a hydraulic feedback via hydraulic devices on the hydraulic pressure of the hydraulic circuit. In addition, in certain embodiments, the variable displacement pump is controlled through another electronic feedback (i.e., through electronic devices), on the pressure of the hydraulic circuit.

According to certain embodiments, the winch assembly comprises a variable displacement motor coupled to the hydraulic circuit and supplied by the variable displacement pump by the hydraulic circuit; the variable displacement motor being configured to vary its displacement according to the pressure detected in the hydraulic circuit.

Another object of the present disclosure is to provide a tracked vehicle which reduces certain of the drawbacks of certain of the prior art.

According to the present disclosure, there is provided a tracked vehicle comprising an engine, such as an internal combustion engine, a first and a second track, and a winch assembly as disclosed herein.

According to certain embodiments, the vehicle comprises a first pump to operate the first track and a second pump to operate the second track.

According to certain embodiments, the tracked vehicle comprises a vehicle control unit connected to the winch control device for defining a drive command signal.

Another object of the present disclosure is to provide a method for operating a winch assembly for a tracked vehicle which reduces at least one of the drawbacks of certain of the prior art.

According to the present disclosure, there is provided a control method for a winch assembly of a tracked vehicle; the winch assembly comprising a revolving drum; a cable wound around the drum; an actuator assembly coupled to the drum to wind or unwind the cable comprising a variable displacement pump and, in certain embodiments, a variable-displacement hydraulic motor; the method comprising the step of controlling the pressure at the pump outlet to control the winding and unwinding of the cable and/or the displacement of the pump to control the winding and unwinding of the cable according to the measured speed of travel of the tracked vehicle, the value of the measured pulling force of the cable, and one or more values selected from the group of values of: cable speed, wound cable length, desired pulling force set manually by an operator, measured angle of the arm of the winch assembly with respect to a direction of travel, and pressure measured in a high pressure branch of a hydraulic circuit of the actuator assembly.

Additional features are described in, and will be apparent from the following Detailed Description and the figures.

BRIEF DESCRIPTION OF THE DRAWINGS

Further features and advantages of the present disclosure will be apparent from the following description of a non-limiting embodiment thereof, with reference to the attached figures, wherein.

DETAILED DESCRIPTION

Figure 1:
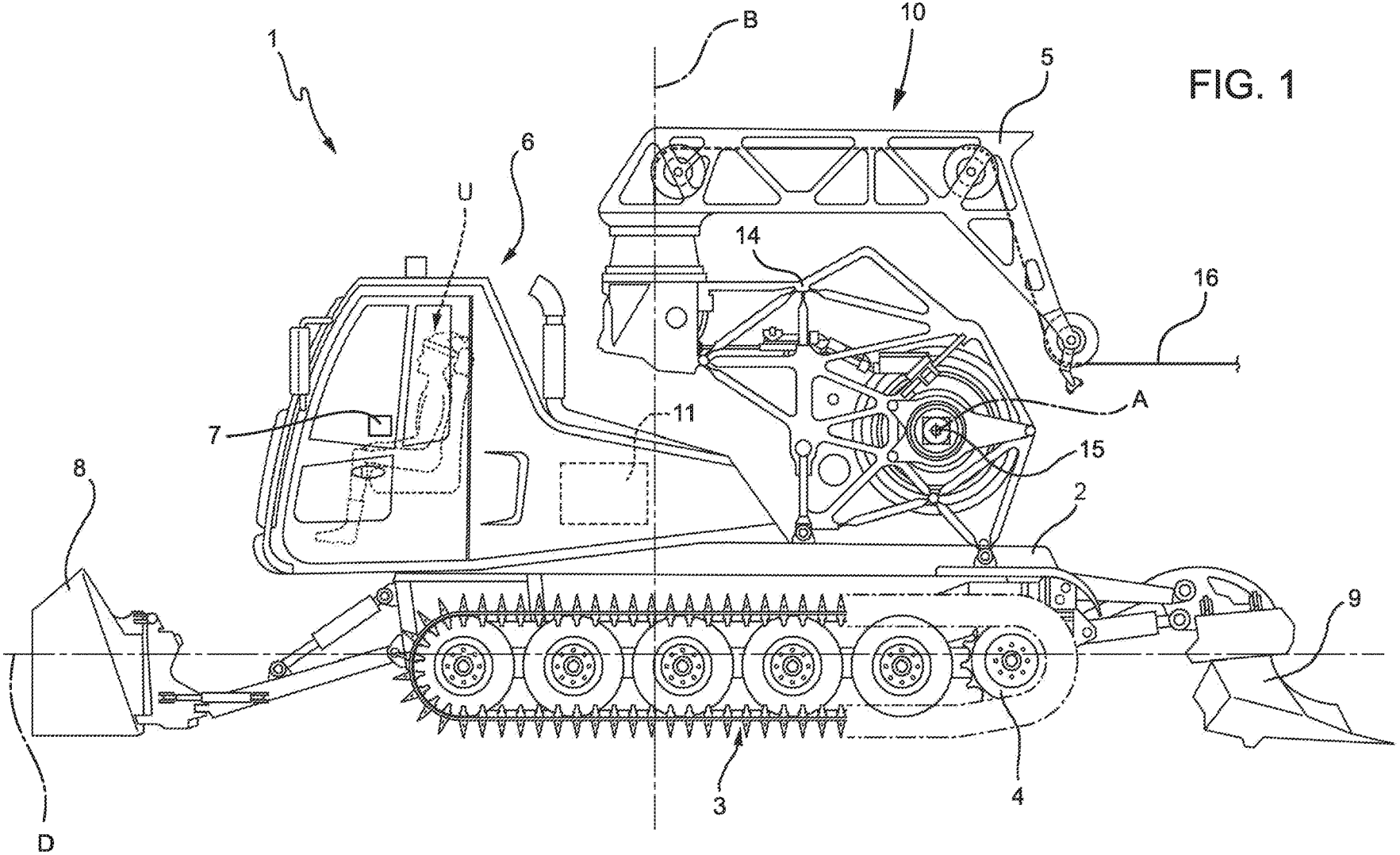
FIG. 1 is a side elevation view, with parts removed for clarity, of a tracked vehicle comprising a winch assembly and constructed in accordance with the present disclosure.

With reference to FIG. 1, reference numeral 1 defines, as a whole, a tracked vehicle. In certain embodiments, the tracked vehicle is a snow groomer for the preparation of ski slopes.

Figure 3:
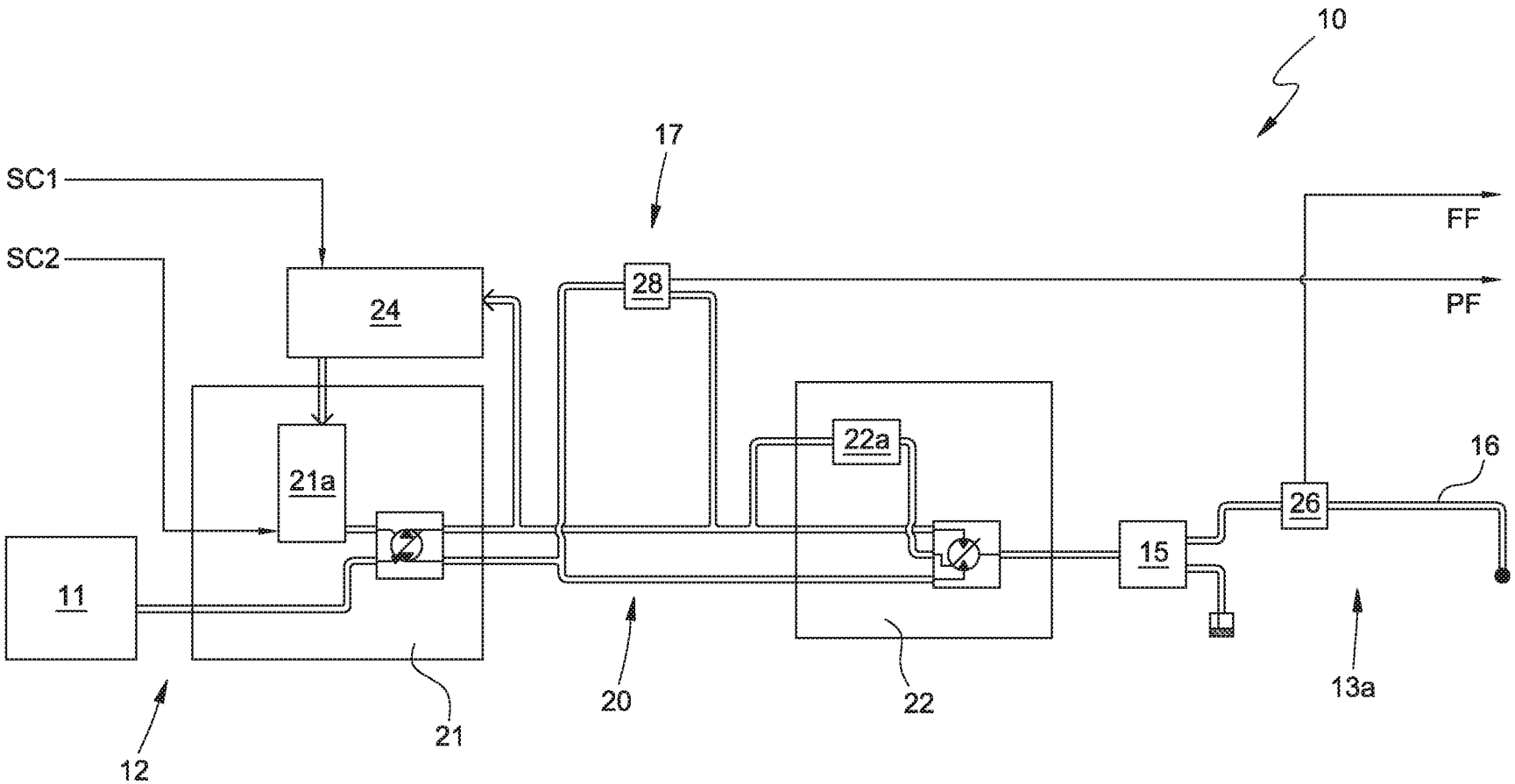
FIG. 3 is a diagram of a detail of the winch assembly of FIG. 1.

The tracked vehicle 1 comprises a chassis 2; two tracks 3 (only one shown in FIG. 1); two drive wheels 4 (only one shown in FIG. 1) operatively coupled to the respective tracks 3; a cabin 6; a user interface 7 located in the cabin 6; a shovel 8 supported at the front by the chassis 2; a tiller 9 supported at the rear by the chassis 2; a winch assembly 10 fixed to the chassis 2; an engine 11, such as an internal combustion engine; and a power transmission 12 (partially visible in FIG. 3) operatively connected to the internal combustion engine 11, the drive wheels 4, the shovel 8 and the tiller 9. Moreover, the power transmission 12 connects the engine 11 to the winch assembly 10.

The power transmission 12 can be hydraulic or electric or a hydraulic and electric combination.

The tracked vehicle 1 comprises a vehicle control unit 13 connected to the user interface 7 and suitable to control the tracked vehicle 1.

The winch assembly 10 comprises a winch control device 13*a* configured to control the winch assembly 10. The winch control device 13*a* is also connected to the user interface 7.

In certain embodiments, the tracked vehicle 1 comprises a first pump (not visible in the attached figures) configured to operate one of the tracks 3 and a second pump (not visible in the attached figures) configured to operate the other track 3.

Figure 2:
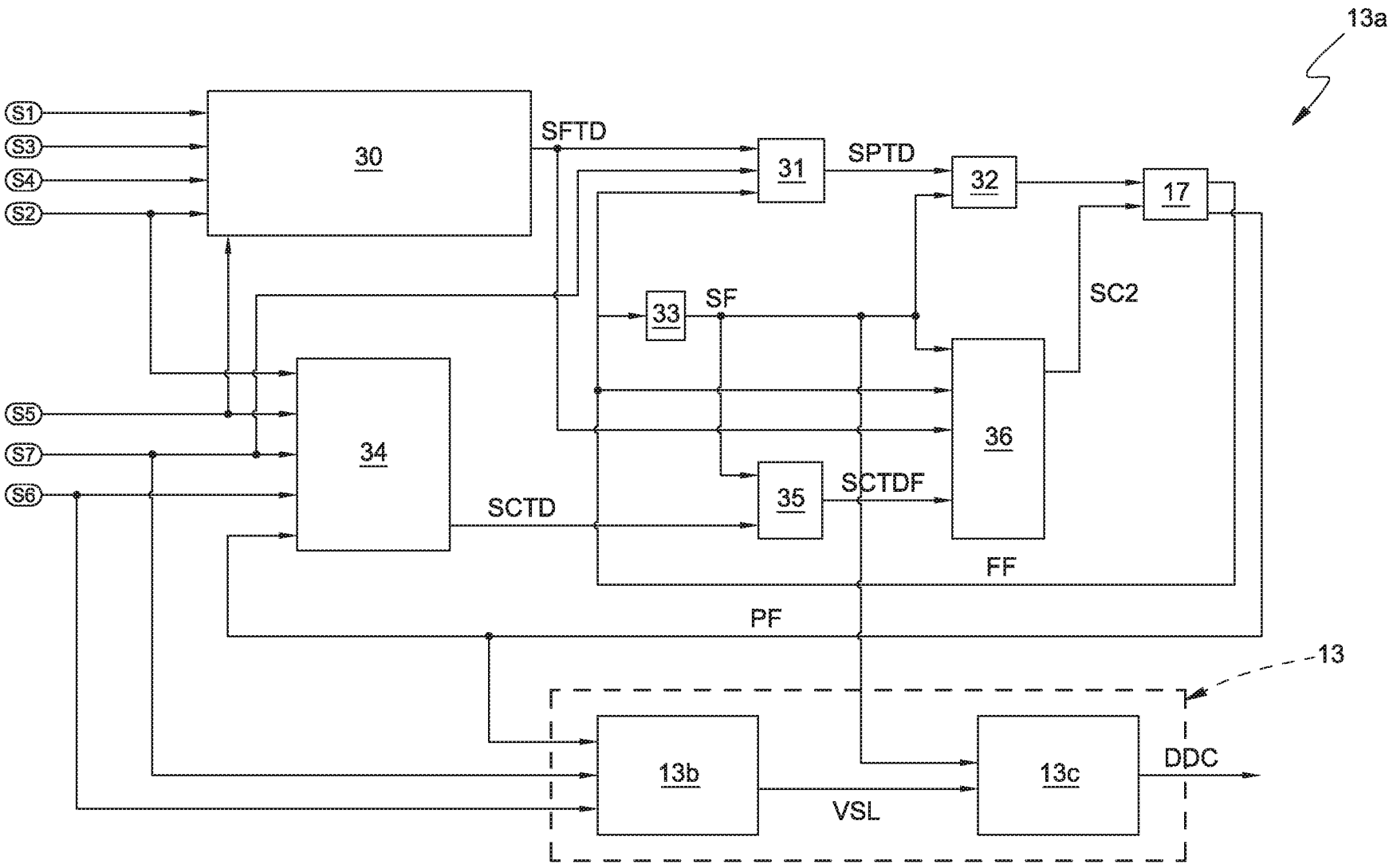
FIG. 2 is a diagram of a detail of the winch assembly of FIG. 1.

With reference to FIGS. 1 and 2, the winch assembly 10 comprises a support structure 14 fixed to the chassis 2, a drum 15 rotatable with respect to the support structure 14 around an axis A; a cable 16 having one end fixed to the drum 15 and wound around the drum 15; an actuator assembly 17 (FIG. 3) coupled to the drum 15 to wind or unwind the cable 16 through a pulling force; and the winch control device 13*a* coupled to the actuator assembly 17 configured to control the pulling force of the cable 16.

The winch control device 13*a* is configured to determine and emit a first control signal SC1 and a second control signal SC2 configured to control the actuator assembly 17.

The actuator assembly 17 is configured to receive the first control signal SC1 and the second control signal SC2 from the winch control device 13*a* and be controlled by the winch control device 13*a* through the first control signal SC1 and the second control signal SC2.

The actuator assembly 17 comprises a hydraulic circuit 20, a variable displacement pump 21 that supplies the hydraulic circuit, and a variable displacement motor 22 that is supplied by the variable displacement pump 21 through the hydraulic circuit 20.

The actuator assembly 17 comprises a hydraulic choke valve 24, the input of which is connected to the high-pressure branch of the hydraulic circuit. In addition, the choke valve 24 is connected to the winch control device 13*a* configured to receive and be controlled through the first control signal SC1. The choke valve adjusts its own output according to the first control signal SC1.

The variable displacement pump 21 comprises a pump control unit 21*a* to vary its own displacement. The pump control unit 21*a* comprises a hydraulic input connected to the output of the choke valve 24, and an electrical input configured to receive an electrical signal connected to the winch control device 13*a* configured to receive the second control signal SC2. In greater detail, the pump control unit 21*a* is configured to vary the displacement of the variable displacement pump 21 according to the value of the pressure received through the hydraulic input and to the value of the electrical signal received by the electrical input. In greater detail, the pump control unit 21*a* adjusts the displacement of the variable displacement pump 21 according to the smaller of the pressure value and the electrical signal value.

In an alternative embodiment, the second control signal SC2 is omitted or has a fixed value always equal to the maximum possible value, in this case the pump control unit 21*a* regulates the displacement of the variable displacement pump 21 according to the value of the pressure received from the hydraulic inlet.

In another alternative embodiment, the first control signal SC1 is omitted or has a fixed value always equal to the maximum possible value, in this case the pump control unit 21*a* regulates the displacement of the variable displacement pump 21 according to the displacement value indicated by the second control signal SC2.

The variable displacement motor 22 comprises a motor control unit 22*a* that is configured to adjust the displacement of the variable displacement motor 22. The motor control unit 22*a* is connected to the high-pressure branch of the hydraulic circuit 20 to receive, as input, the pressurised liquid and adjust the displacement of the variable displacement motor 22 according to the pressure in the high-pressure branch of the hydraulic circuit 20. In other words, the variable displacement motor 22 is configured to vary its own displacement according to the pressure in the high-pressure branch of the hydraulic circuit 20. The pressure of the hydraulic circuit as shown previously is adjusted according to the first control signal SC1. Accordingly, the variable displacement motor 22 is configured to vary its displacement according to the first control signal SC1.

The variable displacement motor 22 is coupled to the drum 15 and acts on the drum 15 configured to adjust the pulling force of the cable 16.

The winch control device 13*a* comprises a force sensor 26, in particular a load cell, coupled to the cable 16 configured to detect the pulling force exhibited by the cable 16.

The force sensor 26 determines and emits a measured pulling force signal FF indicative of the pulling force measured on the cable 16.

The user interface 7 is coupled to the winch control device 13*a* and enables the sending of a desired force command received from the operator U. In greater detail, the user interface 77 emits a desired force signal S4 according to the desired force command received from the operator U.

The winch control device 13*a* comprises a pressure sensor 28 that is coupled to the high-pressure branch of the hydraulic circuit 20 configured to detect the pressure of the hydraulic circuit 20 and emitting a measured pressure signal PF, which is an electrical signal indicative of the pressure in the high-pressure branch of the hydraulic circuit 20.

The tracked vehicle 1 comprises a speed sensor (not shown in the attached figures) to measure the speed of travel of the tracked vehicle 1. The speed sensor is coupled to the winch control device 13*a* to determine and send to the winch control device 13*a* a measured speed of travel signal S2 indicative of the measured speed of travel.

The winch assembly 10 comprises a cable speed sensor (not shown in the attached figures) coupled to the cable 16 to measure the speed of movement of the cable 16 and determine a measured cable speed signal S3 indicative of the measured cable speed S3 to be sent to the winch control device 13*a* In one embodiment of the present disclosure, the cable speed sensor is coupled to the drum and measures the revolutions of the drum and sends the number of revolutions of the drum to the winch control device.

The winch assembly 10 comprises a wound cable sensor coupled to the cable to measure the amount of cable wound around the drum. The wound cable sensor determines and sends a measured wound cable length signal S7 to the winch control device. In one embodiment, the wound cable sensor comprises a computing unit which calculates the amount of wound cable according to the number of positive or negative revolutions of the drum. The sensor that detects the number of revolutions of the drum can be part of the wound cable sensor or be a stand-alone sensor.

The winch assembly 10 comprises an angle sensor coupled to an arm 5 of the winch assembly 10 to measure the angle that the arm 5 of the winch assembly 10 forms with a direction D of travel of the tracked vehicle. The angle sensor determines and sends a measured angle signal S5 to the winch control device 13*a*. In particular, the arm 5 is fixed to the support structure 14 and is rotatable about a vertical axis B. The arm 5 is coupled to the drum 15 and guides the cable 16.

The tracked vehicle 1 comprises a pressure sensor (not shown in the attached figures) coupled to the first and the second pump (not shown), respectively, of one of the tracks 3 and of the other track 3, in particular coupled to the hydraulic circuit of the first pump and to the hydraulic circuit of the second pump. The pressure sensor is configured to define a measured track pressure signal S1 indicative of the difference in pressure between the two hydraulic circuits of the two tracks 3.

The track pressure signal S1, the measured speed of travel signal S2, the cable speed signal S3, the desired force signal S4, the measured angle signal S5, the wound cable length signal S7, the measured pulling force signal FF, the measured pressure signal PF are electrical signals.

The winch control device 13*a* is configured to determine the first and second control signals SC and SC2 according to the signal S2 from the measured speed of travel of the tracked vehicle 1; the measured pulling force signal FF; the cable speed signal S3; the wound cable length signal S7; the measured angle signal S5 and the desired force signal S4.

In greater detail, the winch control device 13*a* defines the first control signal SC1 according to the measured angle signal S5, the cable speed signal S3, the wound cable length signal S7, the measured speed of travel signal S2, the measured pulling force signal FF, and the desired pulling force signal S4.

The winch control device 13*a* also defines the first control signal SC1 according to the track pressure signal S1.

With reference to FIG. 2, the winch control device 13*a* defines the second control signal SC2 according to the measured angle signal S5, the wound cable length signal S7, the measured pulling force signal FF, the measured speed of travel signal S2, the measured pressure signal PF, the cable speed signal S3, and in certain embodiments, the desired pulling force signal S4 and/or the track pressure signal S1.

In addition, the tracked vehicle 1 comprises an engine revolution sensor coupled to the engine 11 and defining a signal S6 from the measured engine revolutions indicative of a measured number of revolutions of the engine 11 of the tracked vehicle 1. The engine revolution signal S6 is an electrical signal.

In certain but non-limiting embodiments of the present disclosure, the winch control device 13*a* defines the second control signal SC2 according to the engine revolution signal S6 in addition to the signals indicated above.

In an alternative embodiment, one or more of the signals listed above are omitted in the determination of the first control signal SC1 and the second control signal SC2 by the winch control device 13*a*.

In an alternative embodiment, the winch control device 13*a* does not define the second control signal SC2 or defines the second control signal with a fixed, non-variable value according to the signals listed above. In this case, the winch control device 13*a* defines the second control signal SC2 as being equal to the maximum possible control signal value SC2.

The two alternative embodiments just described can be combined with each other, in other words one embodiment of the disclosure comprises a winch control device 13*a* which only determines the first control signal SC1 according to the modalities listed above.

In an alternative embodiment, the winch control device 13*a* does not define the first control signal SC1 or defines the first control signal with a fixed, non-variable value according to the signals listed above. In this case, the winch control device 13*a* defines the first control signal SC1 as being equal to the maximum possible control signal value SC1.

The alternative embodiments just described can be combined with each other, in other words one embodiment of the disclosure comprises a winch control device 13*a* which only determines the second control signal SC2 according to the modalities listed above.

In certain but non-limiting embodiments of the present disclosure, the winch control device 13*a* determines the first and second control signals SC1 and SC2 according to the following paragraphs.

The winch control device 13*a* comprises a computing unit 30 configured to calculate a desired theoretical force signal SFTD, indicative of a desired theoretical pulling force value. The control unit 30 receives the measured angle signal S5, the cable speed signal S3, the desired pulling force signal S4, the measured speed of travel signal S2, as input, and defines the desired theoretical force signal SFTD according to the input signals.

In one embodiment, the computing unit 30 receives the track pressure signal S1, as input, and defines the desired theoretical force signal SFTD also according to said signal together with the signals listed above.

The winch control device 13*a* comprises a computing unit 31 connected to the computing unit 30. The computing unit 31 receives the desired theoretical force signal SFTD, the wound cable length signal S7 and the measured force signal FF, as input, and determines a desired theoretical pressure signal SPTD.

The winch control device 13*a* comprises a frequency-adjustable active filter 32 and an oscillation detector 33 configured to receive, as input, the measured pulling force signal FF and provide, as output, a filtering signal SF indicative of one or more frequency values if an oscillation in the measured force signal FF is detected. The oscillation detector 33 is configured to detect the oscillations through the detection of the frequencies related to the harmonics having amplitude values greater than a given or designated value and within a first range of detection frequencies. For this purpose, the oscillation detector 33 can perform an FFT or a DFT or have other electronic means to detect harmonics greater than a given or designated amplitude and within a first range of detection frequencies.

The active filter 32 is frequency-adjusted according to the frequency or frequencies detected by the oscillation detector 33 so as to dampen or eliminate the oscillations in the pulling force. For this purpose, the active filter 32 receives the filtering signal SF and the desired theoretical pressure signal SPTD, as input, and determines the output control signal SC1. The control signal SC1 is defined according to the desired theoretical pressure signal SPTD and filtered of any oscillations indicated by the filtering signal SF.

The winch control device 13*a* also comprises a computing unit 34 which receives the measured speed of travel signal S2, the wound cable length signal S7, the measured angle signal S5 and the measured pressure signal PF, as input, and provides an output desired theoretical displacement signal SCTD calculated according to the input signals.

In certain embodiments, the computing unit 34 receives the engine revolution signal S6, as input, and defines the desired theoretical displacement signal SCTD as well as the signals just listed above.

The winch control device 13*a* comprises a frequency-adjustable active filter 35 connected to the oscillation detector 33. The active filter 35 being frequency-adjusted according to the frequency or frequencies detected by the oscillation detector 33 so as to damp or eliminate the oscillations in the pulling force.

The active filter 35 receives the desired theoretical displacement signal SCTD and the filtering signal SF, as input, and determines a filtered desired theoretical displacement signal SCTDF. The filtered desired theoretical displacement signal SCTDF is determined according to the desired theoretical displacement signal SCTD and filtered of the frequencies indicated in the filtering signal SF.

The winch control device 13*a* comprises a computing unit 36 which receives, as input, the filtered desired theoretical displacement signal SCTDF, the filtering signal SF, the measured pulling force signal FF and the desired theoretical force signal SFTD, and defines, as output, the second control signal SC2 according to the input signals.

Moreover, the vehicle control unit 13 is configured to define a drive command signal DDC according to the engine revolution signal S6, the wound cable length signal S7, the measured pressure signal PF and the filtering signal SF.

In greater detail, the vehicle control unit 13 is connected to the winch control device 13*a* to define the drive command signal DDC.

In greater detail, the vehicle control unit 13 comprises a processing unit 13*b* and a processing unit 13*c*. The processing unit 13*b* receives, as input, the engine revolution signal S6, the wound cable length signal S7, the measured pressure signal PF, and determines a speed limit signal VSL indicating the maximum speed that the tracked vehicle 1 is enabled to reach. The processing unit 13*c* is connected to the processing unit 13*b* and receives the speed limit signal VSL and the filtering signal SF, as input, and defines the drive command signal DDC which determines the travel of the snow grooming vehicle 1. In particular, the drive command signal DDC can control the tracks of the snow grooming vehicle to define the travel of the snow grooming vehicle 1.

It should be appreciated that in accordance with the present disclosure, the control signal SC1 regulates the pulling force of the winch assembly 10 through a feedback control system, which is formed by an electronic feedback control on the measured pulling force in series with a hydraulic feedback control on the pressure of the hydraulic circuit 20. The electronic feedback control is stable and insensitive to internal and external troubles and/or changes in commands and/or changes in loads based on the adjustable active filtering and the oscillation detector.

Moreover, in the embodiment in which the control signal SC2 is adjusted according to the inputs, the pulling force and the pulling speed are adjusted independently and via two electronic feedback controls, which are in series with the hydraulic feedback control. This type of control provides the advantages outlined above combined with the advantage of having a relatively very precise and stable control on the pulling force and the pulling speed even for relatively high values and for relatively fast dynamics due to sudden changes in load. Moreover, this type of control reduces consumption.

It is also evident that the present disclosure also covers embodiments not described in the detailed description and equivalent embodiments, which fall within the scope of protection of the appended claims. Accordingly, various changes and modifications to the presently disclosed embodiments will be apparent to those skilled in the art.

The invention claimed is:

1. A winch assembly comprising:

a support structure;

a drum revolvable with respect to the support structure about an axis;

a cable wound around the drum;

an actuator assembly coupled to the drum and configured to receive at least one of a first control signal indicative of a desired pressure of a variable displacement pump of the actuator assembly and a second control signal indicative of a desired displacement of the variable displacement pump of the actuator assembly; and a winch control device coupled to the actuator assembly to control a winding and an unwinding of the cable and configured to provide at least one of the first control signal and the second control signal, wherein the winch control device is configured to determine at least one of the first control signal and the second control signal based on a measured speed of travel signal indicating a measured speed of travel of a tracked vehicle, a calculated pulling force signal indicating a pulling force on the winch assembly, a wound cable length signal, and at least one of a value of a pressure of at least one pump of at least one track of the tracked vehicle and a value of a pressure difference between two pumps of two tracks of the tracked vehicle.

2. The winch assembly of claim 1, wherein the winch control device comprises:

a frequency-adjustable active filter, and an oscillation detector configured to receive, as an input, the calculated pulling force signal and provide, as an output, at least one frequency value if an oscillation in the calculated pulling force signal is detected, wherein the frequency-adjustable active filter is frequency-adjusted based on at least one frequency detected by the oscillation detector to dampen the oscillations in the pulling force; wherein the winch control device is configured to determine at least one of the first control signal and the second control signal by the frequency-adjustable active filter.

3. The winch assembly of claim 2, wherein the oscillation detector is configured to detect oscillations by detection of the frequencies related to harmonics having amplitude values greater than a designated value.

4. The winch assembly of claim 1, wherein the winch control device is configured to determine the first control signal based on at least one of a measured angle signal of a measured angle of an arm of the winch assembly with respect to a direction of travel, a cable speed signal, the wound cable length signal, the measured speed of travel signal, the calculated pulling force signal and a desired pulling force signal.

5. The winch assembly of claim 1, wherein the winch control device is configured to determine the first control signal based on at least one of a value of at least one pressure of at least one pump which supplies a track of the tracked vehicle and a track pressure signal indicative of a pressure difference between a first hydraulic circuit supplying a first track of the tracked vehicle and a second hydraulic circuit supplying a second track of the tracked vehicle.

6. The winch assembly of claim 1, wherein the winch control device is configured to determine the second control signal based on at least one of the signal from a measured angle signal of a measured angle of an arm of the winch assembly with respect to a direction of travel, a cable speed signal, the wound cable length signal, the desired force signal, the calculated pulling force, the measured speed of travel signal, and a measured pressure signal indicative of a pressure measured in a high pressure branch of a hydraulic circuit of the actuator assembly.

7. The winch assembly of claim 1, wherein the winch control device is configured to determine the second control signal based on at least one of an engine revolution signal and a track pressure signal.

8. The winch assembly of claim 1, wherein the winch control device is configured to determine the second control signal based on a desired theoretical force signal and the winch control device is configured to calculate the desired theoretical force signal based on at least one of a measured angle signal of a measured angle of an arm of the winch assembly with respect to a direction of travel, a cable speed signal, a desired pulling force signal, a track pressure signal, and the measured speed of travel signal.

9. The winch assembly of claim 1, wherein the variable displacement pump of the actuator assembly is configured to supply the hydraulic circuit of the actuator assembly and is configured to vary a displacement based on a pressure of at least one of a pressure in the high pressure branch of the hydraulic circuit of the actuator assembly, and a pressure indicated by the first control signal.

10. The winch assembly of claim 9, wherein the variable displacement pump is configured to vary the displacement based on the second control signal.

11. The winch assembly of claim 9, wherein the actuator assembly comprises a variable displacement motor coupled to the hydraulic circuit of the actuator assembly and configured to be supplied by the variable displacement pump by the hydraulic circuit, wherein the variable displacement motor is configured to vary the displacement based on the pressure detected in the high pressure branch of the hydraulic circuit.

12. The winch assembly of claim 1, wherein a desired pulling force signal is configured to be set manually by an operator.

13. The winch assembly of claim 1, wherein the winch control device is configured to determine at least one of the first control signal and the second control signal further based on at least one of: a cable speed signal, a desired pulling force signal, a measured angle signal of a measured angle of an arm of the winch assembly with respect to a direction of travel, and a measured pressure signal indicative of a pressure measured in a high pressure branch of a hydraulic circuit of the actuator assembly.

14. A winch assembly comprising:

a support structure;

a drum revolvable with respect to the support structure about an axis;

a cable wound around the drum;

an actuator assembly coupled to the drum and configured to receive at least one of a first control signal indicative of a desired pressure of a variable displacement pump of the actuator assembly and a second control signal indicative of a desired displacement of the variable displacement pump of the actuator assembly; and a winch control device coupled to the actuator assembly to control a winding and an unwinding of the cable and configured to provide at least one of the first control signal and the second control signal, wherein the winch control device is configured to determine at least one of the first control signal and the second control signal based on at least one of a value of a pressure of at least one pump of at least one track of the tracked vehicle, and a value of a pressure difference between two pumps of two tracks of the tracked vehicle, and further determine at least one of the first control signal and the second control signal based on a measured speed of travel signal indicating a measured speed of travel of a tracked vehicle, a calculated pulling force signal indicating a pulling force on the winch assembly, and at least one signal of a cable speed signal, a wound cable length signal, a desired pulling force signal, a measured angle signal of a measured angle of an arm of the winch assembly with respect to a direction of travel, and a measured pressure signal indicative of a pressure measured in a high pressure branch of a hydraulic circuit of the actuator assembly.

15. A winch assembly comprising:

a support structure;

a drum revolvable with respect to the support structure about an axis;

a cable wound around the drum;

an actuator assembly coupled to the drum and configured to receive at least one of a first control signal indicative of a desired pressure of a variable displacement pump of the actuator assembly and a second control signal indicative of a desired displacement of the variable displacement pump of the actuator assembly; and a winch control device comprising a frequency-adjustable active filter, and an oscillation detector configured to receive, as an input, a calculated pulling force signal and provide, as an output, at least one frequency value if an oscillation in the calculated pulling force signal is detected, wherein the frequency-adjustable active filter is frequency-adjusted based on at least one frequency detected by the oscillation detector to dampen the oscillations in the pulling force, the winch control device being coupled to the actuator assembly to control a winding and an unwinding of the cable and configured to provide at least one of the first control signal and the second control signal, wherein the winch control device is configured to determine at least one of the first control signal and the second control signal by the frequency-adjustable active filter and based on a measured speed of travel signal indicating a measured speed of travel of a tracked vehicle, the calculated pulling force signal indicating a pulling force on the winch assembly, and at least one signal of a cable speed signal, a wound cable length signal, a desired pulling force signal, a measured angle signal of a measured angle of an arm of the winch assembly with respect to a direction of travel, and a measured pressure signal indicative of a pressure measured in a high pressure branch of a hydraulic circuit of the actuator assembly.

16. The winch assembly of claim 15, wherein the oscillation detector is configured to detect oscillations by detection of the frequencies related to harmonics having amplitude values greater than a designated value.

17. A winch assembly comprising:

a support structure;

a drum revolvable with respect to the support structure about an axis;

a cable wound around the drum;

an actuator assembly coupled to the drum and configured to receive at least one of a first control signal indicative of a desired pressure of a variable displacement pump of the actuator assembly and a second control signal indicative of a desired displacement of the variable displacement pump of the actuator assembly; and a winch control device coupled to the actuator assembly to control a winding and an unwinding of the cable and configured to provide at least one of the first control signal and the second control signal, wherein the winch control device is configured to determine the first control signal based on at least one of a value of at least one pressure of at least one pump which supplies a track of the tracked vehicle and a track pressure signal indicative of a pressure difference between a first hydraulic circuit supplying a first track of the tracked vehicle and a second hydraulic circuit supplying a second track of the tracked vehicle, and determine at least one of the first control signal and the second control signal based on a measured speed of travel signal indicating a measured speed of travel of a tracked vehicle, a calculated pulling force signal indicating a pulling force on the winch assembly, and at least one signal of a cable speed signal, a wound cable length signal, a desired pulling force signal, a measured angle signal of a measured angle of an arm of the winch assembly with respect to a direction of travel, and a measured pressure signal indicative of a pressure measured in a high pressure branch of a hydraulic circuit of the actuator assembly.

* * * * *